US006374870B1

(12) United States Patent
Müller

(10) Patent No.: US 6,374,870 B1
(45) Date of Patent: Apr. 23, 2002

(54) FUEL DISPENSING NOZZLE

(75) Inventor: Odd Müller, Risør (NO)

(73) Assignee: Ide Til Produkt AS, Søgne (NO)

( * ) Notice: Subject to any disclaimer, the term of this patent is extended or adjusted under 35 U.S.C. 154(b) by 0 days.

(21) Appl. No.: 09/372,098

(22) Filed: Aug. 11, 1999

(51) Int. Cl.[7] ..... B65B 1/30; B65B 31/00; B67C 3/02

(52) U.S. Cl. ..... 141/94; 141/59; 141/198; 705/413; 702/45; 235/381

(58) Field of Search ..... 141/59, 94, 198, 141/392; 705/413; 702/45; 235/375, 381

(56) References Cited

U.S. PATENT DOCUMENTS 5,184,309 A * 2/1993 Simpson et al. ..... 364/510
5,605,182 A 2/1997 Oberrecht et al.
5,857,501 A 1/1999 Kelerich et al.
5,913,180 A * 6/1999 Ryan ..... 702/45
5,923,572 A * 7/1999 Pollock ..... 364/528.17

FOREIGN PATENT DOCUMENTS

EP 0719728 A1 7/1996

* cited by examiner

*Primary Examiner*—Timothy L. Maust
(74) *Attorney, Agent, or Firm*—Wenderoth, Lind & Ponack, L.L.P.

(57) ABSTRACT

A gasoline refueling nozzle (3) includes a system for preventing theft of gasoline by leaving without payment after refueling. The nozzle communicates both ways with a chip (7) on the car and a central unit (9) in the gasoline station via two air interfaces (5, 6, 8). The nozzle is equipped with an easily legible display (20) and with a built-in battery (17) for its operation, and the battery is recharged inductively from the gasoline pump (2) via an adapter unit.

14 Claims, 5 Drawing Sheets

FUEL DISPENSING NOZZLE

BACKGROUND OF THE INVENTION

The present invention relates in general to fueling stations for vehicles, and more particularly, to means in connection with safeguarding against theft on fuel from the stations. In accordance with the invention, a refueling nozzle is provided which comprises a forward filing spout, a main body in which the filling spout is attached, a handle section which comprises a finger operated trigger mechanism and which is preferably arranged at the rear end of the main body, and a connector part for a fuel-conducting hose.

System to prevent a gasoline station customer from leaving the station with the car without having paid for the fuel dispensed in a self-service operation are previously know. Video surveillance is quite common, but has clear limitations, since the station staff cannot pay attention all of the time, and such a system is quite dependent on having the staff attend to such a degree that a car registration number can be noted. Nor are video recordings that can be watched after replay sufficient, since the cameras will seldom be able to capture both wide-angle views and clear car registration numbers.

It has been suggested in U.S. Pat. No. 5,890,520 to equip the respective car and car driver with separate transponders to be able to monitor, by means of receivers on the gasoline pumps, the movements of a vehicle as well as a customer, thereby being able to determine whether the car and the customer are leaving the pump area. A disadvantage is, however, that this system is expensive and rather large, and is a requirement that the customer has his/her own PIN code. This has the result that customer and vendor (the gasoline station) will abstain from using the system. It will only be possible to offer this system to specific groups, so the goal regarding stopping gasoline theft will hardly be achieved.

SUMMARY OF THE INVENTION

Thus, there exists a need for a system that is simpler and less expensive to implement than the previously known system, and that can easily be put in to use by all customer groups. This need is satisfied by a refueling nozzle of the type indicated in the introduction, and which in accordance with the invention is characterized in that the main body includes a transmitter/receiver unit (transceiver unit) for two-way electromagnetic communication via two air interfaces, with respectively a vehicle identifying means on a vehicle parked for refueling, or associated with the vehicle, respectively a central unit in a fueling station area, for transmitting a vehicle identification to the central unit.

In a favorable embodiment of the invention, the refueling nozzle includes a built-in power supply system in the main body, comprising one part of an inductive power transfer unit that is operative when the nozzle is inserted in a nozzle cradle between refueling use phases, as well as a recharging circuit connected to the part of the inductive power transfer unit, a rechargeable battery and a CPU (microprocessor) for control. Further, it is preferable that the nozzle is designed to lie/stand in a specially designed nozzle cradle/nozzle holder that contains a second part of the inductive power transfer unit in periods between use phases. This second part can be connected to a fuel supply unit and a power supply net via an adapter unit specially constructed for the fuel supply unit in question and including connectors and possible adaptation circuitry.

In an important embodiment of the refueling nozzle, it is equipped in a forward part of the main body with a fuel condensate recovery device, which device includes a forwardly tapered sleeve surrounding a rear portion of the filling spout. On its exterior, the sleeve is covered by a soft material in order to provide a sealing effect when engaging the vehicle fuel filler neck. The sleeve has at least one opening at its forward edge for receiving fuel vapor that may flow into an inner sleeve region where vapor can condense to be recovered, possibly using a Venturin principle.

Preferably the nozzle is electronically self-contained, with all necessary functions for communication, power supply, user information and possibly quantity control. It is preferably if the nozzle has a user information and communication system that comprises a battery-powered CPU connected to a radio frequency communication unit and to a display unit for displaying changing visual information. The display unit may be divided into two sections for displaying respectively data regarding the refueling and additional information, e.g. advertising. The display unit may alternatively be arranged with superimposed information, however, in such a manner that the refueling data are always visible during the process of refueling.

When the refueling nozzle is electronically self-contained as mentioned above, it may have a quantity control system that includes a battery-powered CPU connected to trigger, valve and flow rate sensors, as well as to a sensor device for car tank filling level, and possible to a quantity meter in a fuel pump via a radio frequency communication unit. The CPU is preferably operative to control built-in valves for start/stop, dosage and kick stop, based on signals from sensors for trigger mechanism status, for flow rate measurement and for detection of tank filling level. Preferably, the sensor device for tank filling level is of an optical type.

In a second aspect of the invention, there is provided an adapter with interface function between a refueling nozzle and a fuel supply unit, which adapter is operative when the nozzle rests or is supported therein in an inoperative state. The adapter is characterized in that it includes (a) a nozzle cradle containing a second part of an inductive power transfer unit for recharging the nozzle, which nozzle contains a first part of the power transfer unit, as well as (b) an adapter unit which constitutes an interface between the nozzle cradle and the fuel supply unit, and is custom adapted to the fuel supply unit. The second part can be connected to a power supply net via the adapter unit and the fuel supply unit.

BRIEF DESCRIPTION OF THE DRAWINGS

In the following, the invention shall be illuminated further through a description of embodiment examples, and in connection with the appended drawings, where.

DETAILED DESCRIPTION OF THE PREFERRED EMBODIMENTS

Figure 1:
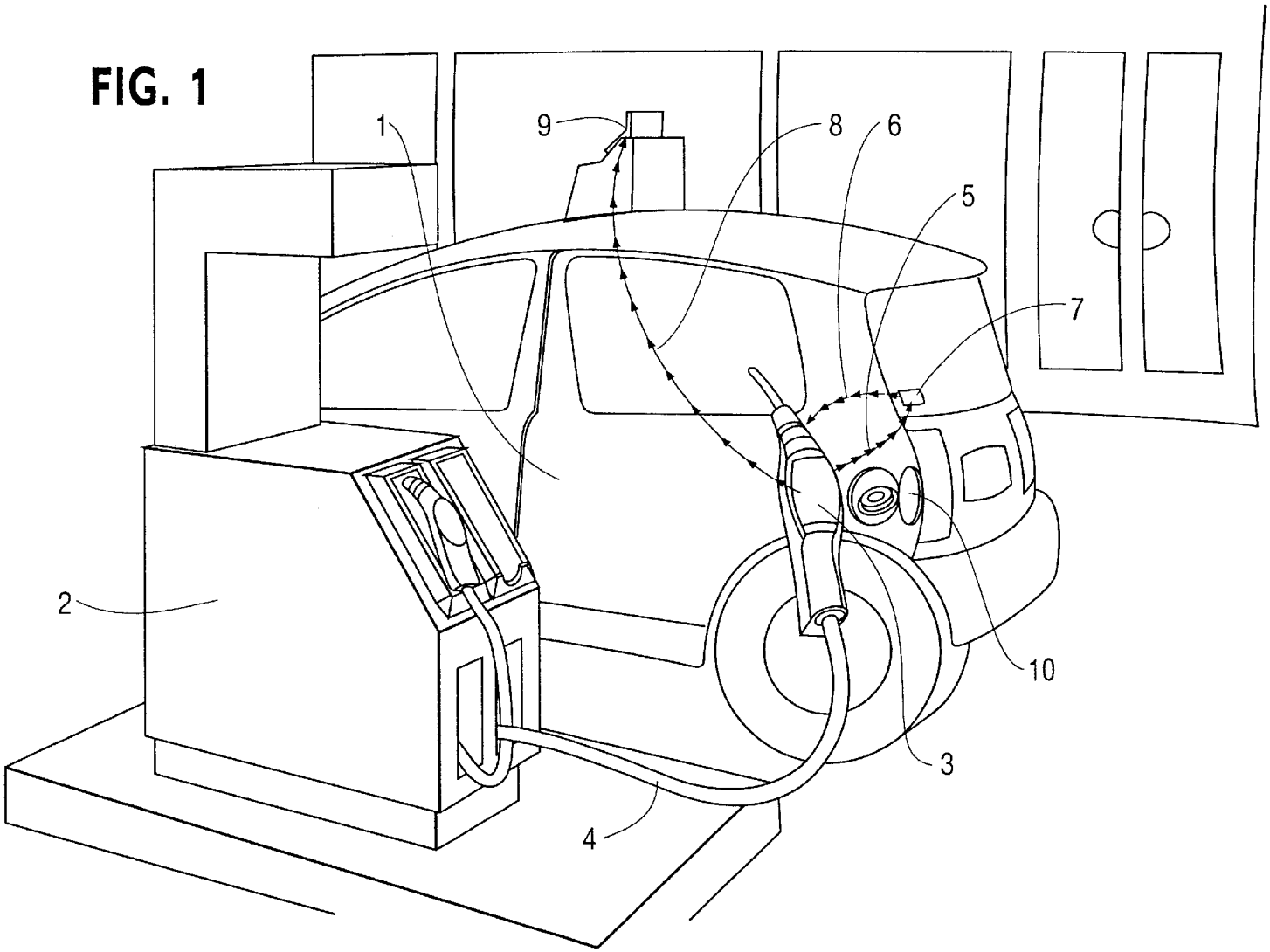
FIG. 1 shows a sketch of a car next to a gasoline pump with a nozzle in accordance with an embodiment of the invention.

FIG. 1 shows a situation in which an automobile 1 has been parked for refueling at a fuel supply unit in the form of e.g. a gasoline pump 2. A refueling nozzle 3 is provided at the end of a fuel hose 4. The invention nozzle 3 includes a transceiver unit (16, see FIG. 2) transmitting signals 5 to and receiving signals 6 from a car identifying means having the form of e.g. a transponder chip 7 attached to the car 1, as well as signals 8 to (and possible from) a central unit 9 in the area, e.g. inside the gasoline station store.

The chip 7 can be mounted in a suitable position on the car, preferably on the inside of the car window, or it may be placed close to the tank filler cover 10, or possibly on the inside thereof. Communication takes place e.g. by means of a system similar to the "Køfri" system, in which a radio frequency wave, infrared light, an inductive near field, or for that matter, ultrasound is used to interrogate the chip from the nozzle 3. A high frequency radio signal may be the most suitable choice, such a signal being able to bring about a return signal from a passive chip 7 in a per se known manner. If the chip 7 is of the active type (i.e. Including its own power supply battery), the other signal types may easily be used.

The chip 7 is unique for the car in questions, i.e. it provides an unambiguous identifying signal back to the nozzle 3. The nozzle then transmits a signal 8, preferably in a different frequency range than the range of the interrogation signal, to the central unit 9. If e.g. "the car credit" or other conditions should indicate so, the central unit may return a blocking signal to the nozzle 3, to that no refueling can be executed. However, it no remark can be found in the central unit register, refueling can be done, possible after returning an "OK" signal to the nozzle.

If now the car or the customer should leave the station without paying after the self-service operation, the car and/or customer identity has now been entered, together with the visiting time and amount due for the fuel, in the central unit register, and necessary steps can be taken to make up for this matter. Hence, the system is clearly preventive and problem-solving regarding gasoline theft, which occurs quite often and constitutes a real problem in this line of business.

Figure 2:
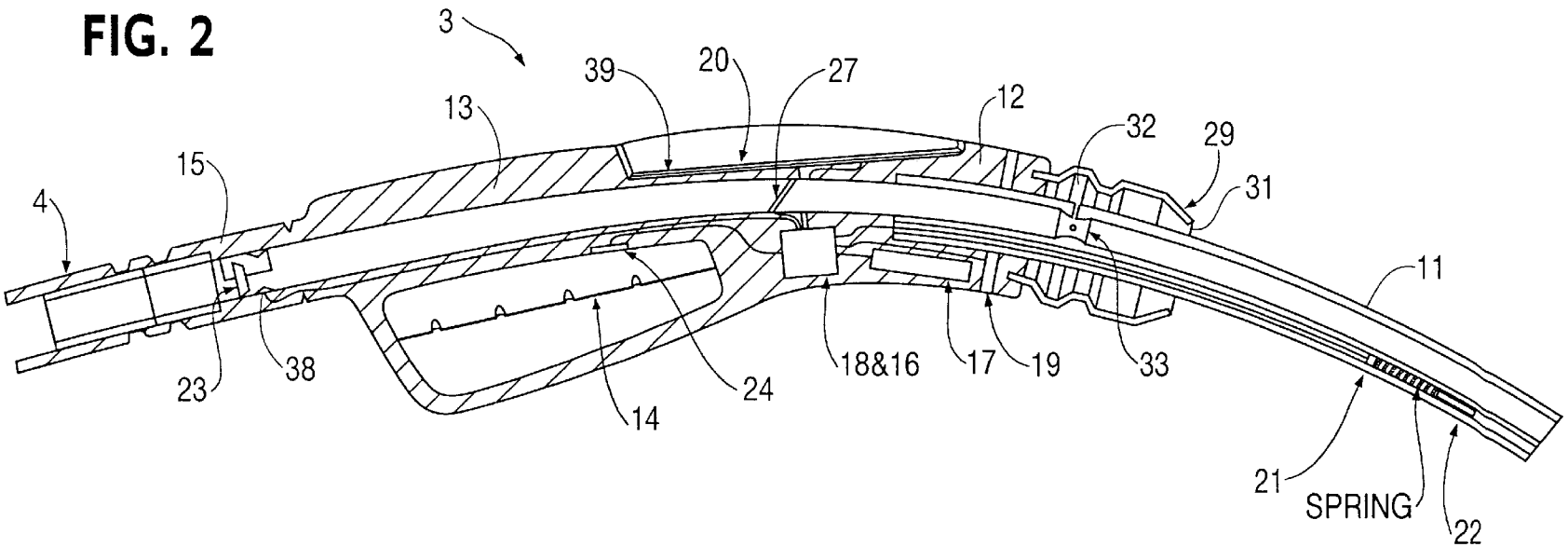
FIG. 2 shows a longitudinal section through a nozzle in accordance with an embodiment of the invention.

In FIG. 2 there is shown a longitudinal section through a favorable embodiment of a refueling nozzle 3 in accordance with the invention. Far to the right in the figure appears the forward nozzle filling spout 11, to be inserted down into the car fuel filler neck. The filling spout 11 is attached to a main body 12. At the rear end of the main body 12 here is arranged a handle section 13, which includes a finger operated trigger 14. At the rear end there is a connector part 15 for the fuel hose 4.

The main body exhibits in its preferred embodiment a rechargeable battery 17, a processor 18 and one part 19 of an inductive power transfer unit. In the embodiment shown, the processor 18 is arranged together with a unit 16 for transmitting and receiving electromagnetic signals. The signals are transmitted together with a display 20, to and from the chip 7 on the car, and to and from the central unit 9. In a preferred exemplary embodiment, the unit 16 comprises existing RF technology that can be purchased, the design thereof being adapted to the rest of the nozzle. The frequencies to be utilized must be adapted to national RF standards, and must in general be approved Euro/USA frequencies. In its preferred embodiment the nozzle 3 has its own power supply from the battery 7. However, this battery must be recharged in the phase between refueling operations, and the preferred energy transfer method is inductive transfer, i.e. a transformer type transfer in which the nozzle 3 contains the "secondary winding" 19 and a nozzle holder (35, see FIG. 5) contains the "primary winding" (40). Thereby the nozzle holder/cradle 35 exhibits no visible electrical connector in its interface toward the nozzle.

In addition, the processor 18 controls and monitors the recharge process in a per se known manner.

Hence, the nozzle is self-contained as regards electronics, i.e. it includes means for communication (16), power supply (17) and control (18). In the preferred embodiment, the nozzle further includes an integrated display 20 which is also controlled by processor 18, and this display is operative to provide information for the customer during refueling in a very favorable manner. It is of course possible to provide other types of information, e.g. advertising, in the display, that is situated in a favorable position regarding a combined view of gallon/price information together with a possible advertisement message. The display 20 may possible be of a type with rapid updating, possibly in a color display. LCD display technology of the reflective type, which is easily legible in daylight, will presumably be preferred. The additional information is received, preferably in a wireless manner, from the central unit 9, which itself can be connected to external information suppliers.

It appears also from FIG. 2 that the processor 18 is connected to various means in the nozzle. Inside the filling spout 11 is provided a sensor, preferably of an optical type. This sensor detects the distance to the gasoline surface in the car filler neck by optical range finding in a per se known manner. However, FIG. 2 shows another preferred embodiment, in which the sensor 21 detects a compressive force from a spring which in its other end has a float organ 22 that is able to rise with gasoline level or with an increasing pressure from below. At a given range or pressure threshold, the processor stops the flow of petrol by closing valve 23 in the hose connector part 15. On the other hand, valve 23 is opened by the processor when it receives a signal from a trigger sensor 24. The processor can also be connected to a flow rate sensor 27, and possibly to a quantity meter in the gasoline pump 2 via a RF communication.

The nozzle 3 is, in its preferred embodiment, designed with a curved shape in order that the display 20 shall be easily legible also when the filling spout 11 has been pushed all the way into the car filler neck, and possibly the display may even by angled somewhat upward.

Figure 3:
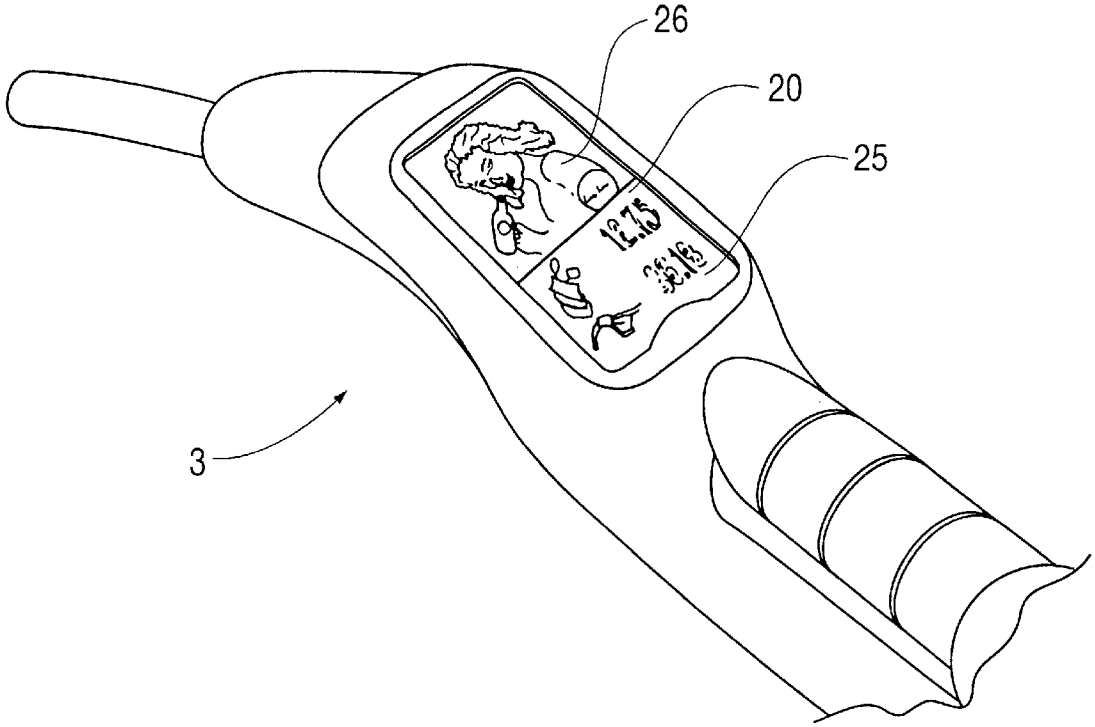
FIG. 3 shows an example of a display on a nozzle in accordance with the invention.

The display 20 may preferably be arranged in two parts such as shown in FIG. 3, that is with e.g. price/gallon display in a field (area) closer to the customer's eyes, and an advertising field 26 therebeyond. It is also possible to use one and the same field, with superimposed information types, however always in such a manner that the necessary refueling data are easily visible to the customer during progress of the refueling process.

As previously mentioned, the processor 18 is also connected to the display 20 for operation thereof, as well as to the communication unit 16. It thereby appears that the nozzle 3 actually includes a complete user information and communication system, including its own power supply.

Figure 4B:
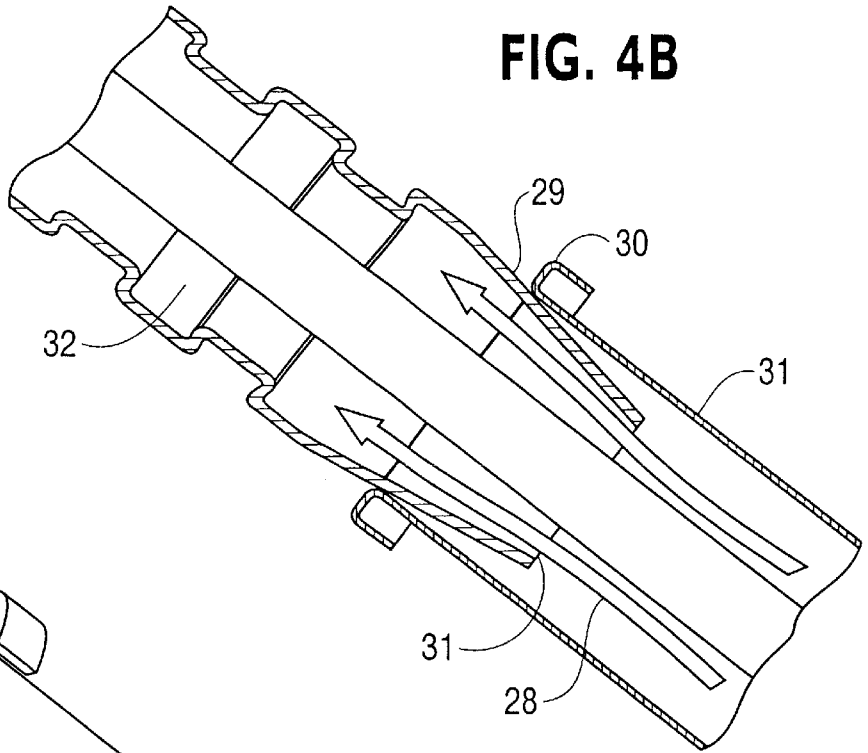
FIGS. 4A and 4B show details of a condensate recovery means in a nozzle in accordance with an embodiment of the invention.
Figure 4A:
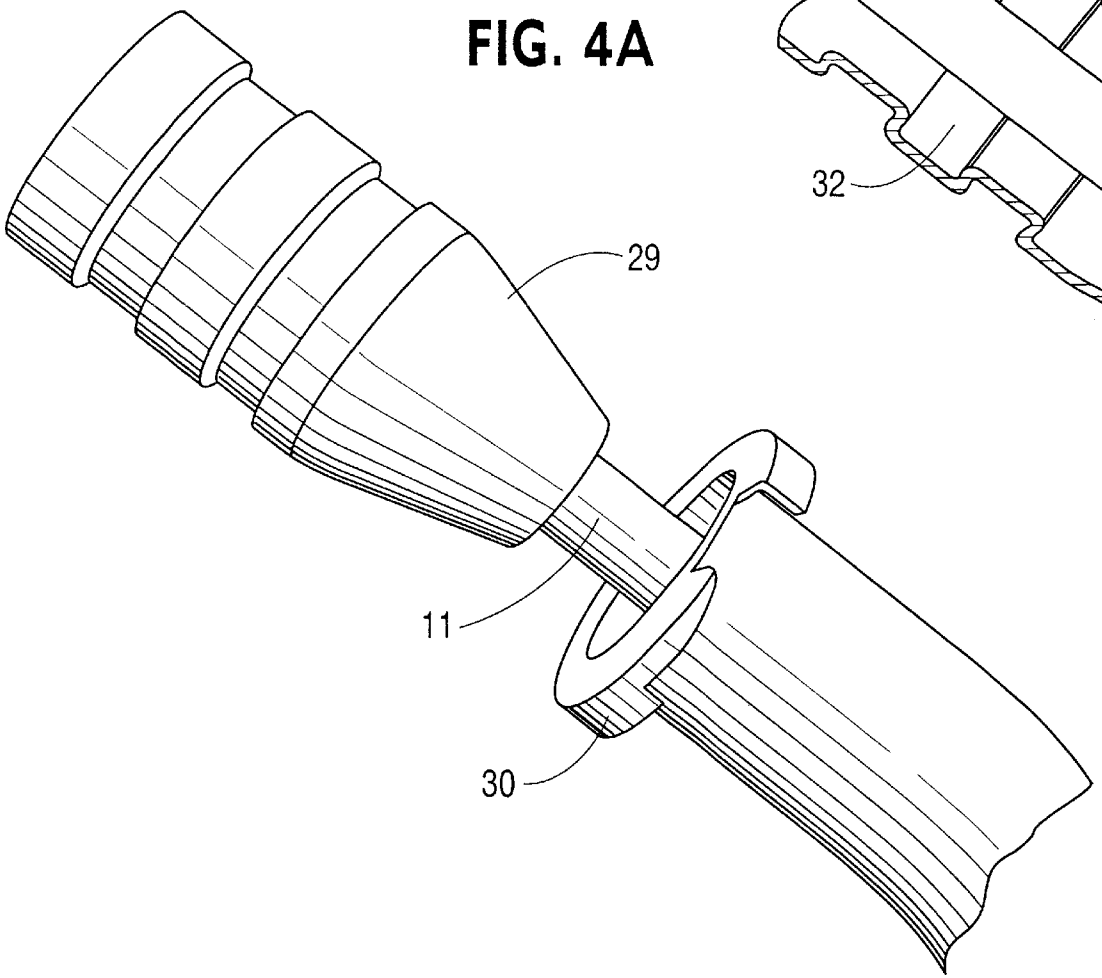

In FIG. 2 and FIG. 4 appears a system that it is necessary to associate with the nozzle 3 when the customer, in accordance with the nature of the invention, must keep up watching a display on the self-contained refueling nozzle, i.e. a system for removing petrol vapor 28 (FIG. 4) from the tank filler neck of the car. Inhaling of such vapor is unpleasant and damaging to health. In accordance with an aspect of the invention, the forward part of the nozzle main body 12 is therefore equipped with a forward tapered sleeve 29 surrounding the rear part of the filling spout 11 in order to provide a seal against the car tank filling neck 30 during refueling. The sleeve 29 is clad on its outside with a soft material to provide a good seal. The forward edge of the sleeve 29 has one or several openings 31 through which petrol vapor 21 may flow up and into the sleeve. In an inner region 32 of sleeve 29, this vapor may be caused to condense, possibly by means of a (not shown) cooling system, and condensed liquid may then either flow down back to the car filler neck through the sleeve openings 31, or it may possibly be drawn into the gasoline flow in the nozzle again by means of a Venturi device 33, which device may also cause gasoline vapor to be carried along together with the gasoline flow and down into the car tank again.

Figure 5B:
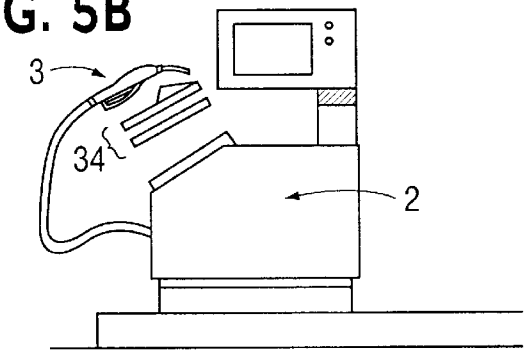
FIGS. 5A and 5B show an embodiment of an adapter set for use between a nozzle in accordance with the invention and an existing nozzle cradle.
Figure 5A:
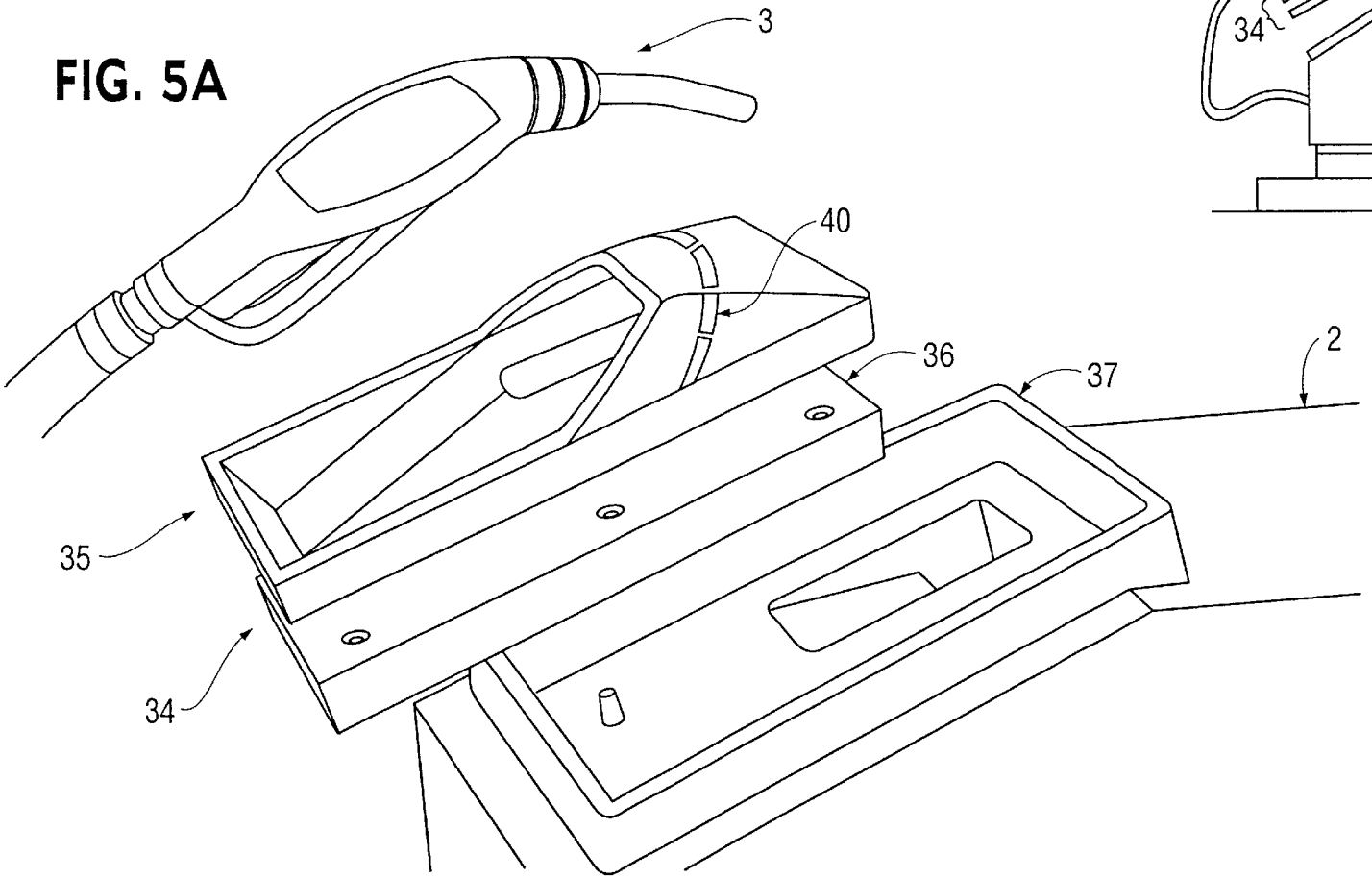

In order to utilize the fueling nozzle in accordance with the invention without having to undertake considerable re-building of existing fuel pumps, it is necessary to design a transition system. In accordance with a further aspect of the invention, FIG. 5 shows an adapter 34 which is in two parts, i.e. one section 34 that is adapted to the nozzle 3 itself, and one section 36 that is adapted to the particular gas pump top 37 which is of interest, i.e. the original nozzle cradle part of the gas pump.

The adapter 34 becomes operative when the nozzle 3 is laid or hung into it, i.e. at that moment a recharging process is started (if necessary) for the nozzle battery 17. As previously mentioned, the nozzle contains a first part 19 of an inductive power transfer unit, and section 35 contains a second part 40 of the power transfer unit, i.e. the "primary winding" of the transformer-like system. The adapter section 36 is connected to section 35 by means of connectors. Section 36 uses, in its interface with the previous (original) nozzle holder 37, for instance an existing "pump stop/start switch" built into the present device, as a current source, so that electrical power can be supplied for the recharge operation.

Finally it must be repeated that gasoline theft is eliminated by means of this invention by having the chip 7 read automatically from nozzle 3, and having a message sent to the central unit 9 in the gasoline station, which central unit may then control the identity and successively filled gasoline volume and monetary amount. The identification from the system is contrasted to the amount etc., and upon received payment, deletion can be executed.

I claim:

1. A refueling nozzle comprising:

a forward filling spout;

a main body in which said filling spout is attached;

a handle section, including a finger operated trigger mechanism, connector with said main body;

a connector part for connection with a fuel-conducting hose;

a transceiver unit for two-way electromagnetic communication via two air interfaces with a vehicle identification unit associated with a vehicle parked for refueling and a central unit in a fueling station area for transmitting vehicle identification to the central unit, respectively; and a display unit for displaying changing visual information received from the central unit and from a built-in quantity control system in said nozzle, said display unit comprising two parts including a part displaying refueling data and a part displaying additional information;

wherein said main body has a curved nozzle top surface and said display unit has a top cover that has a curved shape to substantially match and lie flush with said curved nozzle top surface.

2. The nozzle of claim 1, wherein said two parts of said display unit are provided by superimposing the refueling data and the additional information such that the refueling data are always visible during refueling.

3. The nozzle of claim 1, wherein said main body further comprises a built-in power supply system including a first part of an inductive power transfer unit operative when said nozzle is in a nozzle cradle between refueling phases, a recharge circuit connected to said first part of said inductive power transfer unit, a rechargeable battery connected with said recharge circuit and a CPU connected with said recharge circuit.

4. The nozzle of claim 1, wherein said main body comprises a forward part including a fuel condensate recovery unit comprising a forwardly tapered sleeve surrounding a rear part of said filling spout, said sleeve having an exterior covered with a soft material to provide a sealing effect when said sleeve engages a car filler neck edge, an internal sleeve region where vapor may condense and be returned to said filling spout, a forward edge, and at least one opening in said forward edge for receiving fuel vapor to flow into said internal sleeve region.

5. The nozzle of claim 4, wherein said internal sleeve region comprises a Venturi principle structure for returning vapor to said filling spout.

6. The nozzle of claim 1, wherein said nozzle comprises electronic systems including a communication system, a power supply system, a user information system and a quantity control system.

7. The nozzle of claim 6, wherein said user information system and communication system include a battery powered CPU connected to an RF communication unit, which includes said transceiver unit, and said display unit.

8. The nozzle of claim 1, wherein the additional information is advertising information.

9. A refueling nozzle comprising:

a forward filling spout;

a main body in which said filling spout is attached;

a handle section, including a finger operated trigger mechanism, connected with said main body;

a connector part for connection with a fuel-conducting hose;

a transceiver unit for two-way electromagnetic communication via two air interfaces with a vehicle identification unit associated with a vehicle parked for refueling and a central unit in a fueling station area for transmitting vehicle identification to the central unit, respectively; and a display unit for displaying changing visual information received from the central unit and from a built-in quantity control system in said nozzle, said display unit comprising two parts including a part displaying refueling data and a part displaying additional information;

said main body comprising a built-in power supply system including a first part of an inductive power transfer unit operative when said nozzle is in a nozzle cradle between refueling phases, a recharge circuit connected to said first part of said inductive power transfer unit, a rechargeable battery connected with said recharge circuit and a CPU connected with said recharge circuit; and a nozzle cradle for receiving said main body with said filling spout between use phases, said nozzle cradle including a second part of said inductive power transfer unit, said second part being connected with a fuel supply unit and a power supply net by an adapter unit, wherein said adapter unit comprises connectors for connecting said adapter unit to said fuel supply unit.

10. The nozzle of claim 9, wherein said adapter unit further comprises adaptation circuitry.

11. A refueling nozzle comprising:

a forward filling spout;

a main body in which said filling spout is attached;

a handle section, including a finger operated trigger mechanism, connected with said main body;

a connector part for connection with a fuel-conducting hose;

a transceiver unit for two-way electromagnetic communication via two air interfaces with a vehicle identification unit associated with a vehicle parked for refueling and a central unit in a fueling station area for transmitting vehicle identification to the central unit, respectively; and a display unit for displaying changing visual information received from the central unit and from a built-in quantity control system in said nozzle, said display unit comprising two parts including a part displaying refueling data and a part displaying additional information;

wherein said nozzle comprises electronic systems including a communication system, a power supply system, a user information system and a quantity control system; and wherein said quantity control system comprises a battery-powered CPU connected to trigger, valve and flow rate sensors and to a tank filling level sensor.

12. The nozzle of claim 11, wherein said quantity control system further comprises said battery-powered CPU being connected with a quantity meter of a fuel pump by an RF communication unit.

13. The nozzle of claim 11, wherein said CPU is operative to control at least one valve in said main body for starting and stopping of fueling, dosage of fuel and kick stop based on signals from said trigger, flow rate and tank filling level sensors.

14. The nozzle of claim 11, wherein said tank filling level sensor is an optical sensor.

* * * * *